United States Patent [19]

Werner

[11] Patent Number: 4,733,510

[45] Date of Patent: Mar. 29, 1988

[54] FRAMED PANEL ASSEMBLY

[75] Inventor: David G. Werner, Oshkosh, Wis.

[73] Assignee: R & H Partners, Little Chute, Wis.

[21] Appl. No.: 761,171

[22] Filed: Jul. 31, 1985

[51] Int. Cl.[4] ..... E06B 3/26

[52] U.S. Cl. ..... 52/202; 49/62

[58] Field of Search ..... 52/202, 203; 49/61, 49/62

[56] References Cited

U.S. PATENT DOCUMENTS

| | | | |
|---|---|---|---|
| 3,992,815 | 11/1976 | Potter | 52/202 X |
| 4,184,297 | 1/1980 | Casamayor | 52/202 |
| 4,441,290 | 4/1984 | Abell | 52/202 |
| 4,452,020 | 6/1984 | Werner | 52/202 |
| 4,454,691 | 6/1984 | Mitchell | 52/202 |
| 4,581,865 | 4/1986 | Miller | 52/202 |

*Primary Examiner*—Carl D. Friedman

*Attorney, Agent, or Firm*—Thomas D. Wilhelm

[57] ABSTRACT

Improved framed panel assemblies are disclosed, especially as adapted for use as windows to be installed over existing windows, especially to improve the capability of the window to provide insulation from the outside air. Various embodiments have reinforcing means for the assembly components, improvements in the joining of the elements of the assemblage, and a strip.

7 Claims, 22 Drawing Figures

FRAMED PANEL ASSEMBLY

BACKGROUND OF THE INVENTION

This invention relates to framed panel assemblies in general, and most specifically, as disclosed herein in the illustrated embodiments thereof, to windows and the like which can be added to existing windows to improve the capability of the window to provide insulation from the outside weather. Such panel assemblies are commonly called storm windows, and may be installed either on the inside or outside of a building.

Some previous storm windows have the disadvantage that they must be installed as original equipment on the building or replace the entire window and frame; or sometimes the glazing must be removed separately from the frame. Exemplary of these storm windows are those taught in U.S. Pat. Nos. 3,992,815 issued to Potter and in 4,184,297 issued to Casamayor.

In my previously issued U.S. Pat. No. 4,452,020, I disclose a storm window having a frame contiguous therewith, and a retainer strip so sized and configured that retainer means on the retainer snaps into retainer means on the frame to hold the storm window to the retainer by means of continuous joinder of the storm window frame to the retainer about the perimeter of the storm window frame. The retainer strip is configured for concurrent attachment to the frame of an existing window in a building, thus attaching the entire assemblage to the existing window in such a way as to improve the insulating properties of the overall window unit.

While the window assemblages disclosed in my previously referenced U.S. Pat. No. 4,452,020 are highly effective and useful, this invention provides still further improvements in my designs of window assemblages, to make the windows stronger and to give them even greater capabilities of insulating a window area from outside weather.

SUMMARY OF THE INVENTION

The objectives of the invention are achieved in an improved framed panel assembly for attachment to a surface. In one family of embodiments, the primary components of the assembly are a panel assembly frame, an adapter, and a strip. The panel assembly frame has a first perimeter, a means for receiving a panel, and a first retainer means attached to a face of the frame and extending about the frame.

The purpose of the adapter is for cooperatively attaching the frame to the surface. The adapter has a second perimeter and a second retainer means for joining with the first retainer means. In the overall assembly, the adapter extends about the assembly frame in joined relationship with the frame.

The strip has an edge, and is attached by one edge to either the frame or the adapter. Usually, the strip extends along the length of the assembly component to which it is attached. It is also typical that it extend toward the other primary component.

In the preferred embodiments, the frame and adapter are so configured that, when the frame is placed in mating relationship with the adapter, the first and second retainer means can be separably joined.

In some embodiments, the strip is attached to the first retainer means, or to some other portion of the frame. In other, and preferred, embodiments the strip is attached to the adapter.

In some embodiments, the frame is considered as having a first base member, with the first retainer means extending from the first base member; and the adapter is considered as having a second base member, with the second retainer means extending from the second base member. In these embodiments, the strip may be defined as extending from either the first or second base member. Usually it extends toward the other member.

In a family of preferred embodiments, one of the first and second retainer means is bulbous, and extends from one of the first and second base members. The strip, in this family of embodiments, is attached to either the frame or the adapter, and an edge of it is disposed for engagement between the bulbous portion and the corresponding base member from which the bulbous portion extends.

In a series of most preferred embodiments, the strip is attached to the second base member. From there an edge of it may be disposed for engagement between a bulbous second retainer means and the second base member. It may simultaneously, or separately, engage the first retainer means, in a sealing relationship which may be functional for improving the insulating properties of the panel assembly.

The panel assembly may further include a rib, attached to, and extending generally about the perimeter of either the frame or the adapter and extending, along a length of the rib, in generally the same direction as the primary component to which it is attached.

In those embodiments having a rib, it is fully satisfactory for the strip to be attached to the rib; and it usually will extend toward the other primary component to which it and the rib are not attached.

In many of the preferred embodiments of the invention, the frame and adapter both have a plurality of elements. The frame, thus, is comprised of a plurality of frame elements where two members of a pair of the frame elements are adjoining, and where ends of the adjoining frame elements are in generally end-to-end relationship. Similarly, the adapter is comprised of a plurality of adjoining adapter elements, where ends of the adjoining elements are in generally end-to-end relationship. When frame elements and adapter elements are thus used, means, separate from a panel, are desirably used for joining together the adjoining pairs of frame elements. An economical and efficient means is a key extending between a pair of elements and extending into an end of each member of the pair of elements. In a similar manner, joining means may be used for joining together a pair of adapter elements.

In another family of preferred embodiments of the invention, the primary components of the assembly are a panel assembly frame, an adapter, and a rib. Each of the components is as previously described. Thus the frame has a first perimeter, means for receiving a panel, and a first retainer means attached to a face of the frame and extending about the frame. The adapter has a second perimeter and a second retainer means for joining with the first retainer means. And in the overall assembly, the adapter extends about the assembly frame in joined relationship with the frame.

The rib is attached to, and extends generally about, the perimeter of either the frame or the adapter, and extends in generally the same direction as the corresponding retainer means on the primary component to which it is attached. In some preferred embodiments, the rib, in combination with the retainer means which is attached to the same primary component, forms a channel means, preferably a channel means separate from the retaining function of the retainer means.

As in the other embodiments described hereinabove, in the embodiments wherein the rib is a primary component, the frame and adapter are typically composed of a plurality of frame elements and adapter elements respectively. Like end-to-end relationships are essentially the same as above as are the means for joining them, preferably a key between the frame elements or between the adapter elements, or both.

Regarding the joints in the frame and the adapter, these joints are typically coplanar, as at a corner, and form a single locus of joinder of two portions of the assembly. Usually one key is sufficient to join the locus of joinder, the key extending between the two portions into each of the portions. The key may engage only the frame elements, only the adapter elements, or a combination of frame elements and adapter elements. The joined portions may, of course, include an attached strip as hereinabove described. The strip would also usually be composed of elements in the same proportion as the frame elements and adapter elements to which it may be attached.

In yet another family of preferred embodiments, of the invention the primary components are a panel assembly frame comprised of a plurality of frame elements, an adapter comprised of a plurality of adapter elements, and means for joining together corresponding frame elements and adapter elements at a common locus of joinder as described hereinabove. Like end-to-end relationships are again essentially the same as above, as are the means for joining them, preferably a key between the respective frame elements or between the respective adapter elements, or both. It is also contemplated, within this family, to join together either a pair of frame elements or a pair of adapter elements, and not necessarily both, or perhaps both, but not both at the same location. The preferred means for joining is also a key in this family, just as in the earlier described families.

In any of the embodiments of this invention, it is highly satisfactory for the first retainer means to be essentially an open channel which is capable of receiving the second retainer means thereinto. Likewise, it is highly satisfactory for the second retainer means to be essentially an open channel which is capable of receiving the first retainer means thereinto.

DETAILED DESCRIPTION OF THE ILLUSTRATED EMBODIMENT

In its most common application, the invention pertains to use of the assemblies of the invention as seasonal storm windows which are added to permanently installed windows in building structures either on the inside or outside of the building structure. The description of the invention herein is directed specifically at window-type uses, with the understanding that other uses may be made of the invention, wherein the assembly performs the same function of attaching a frame to a surface.

As used herein a "surface" may be as simple as a flat portion, such as of a wall. Equally well, a surface may have a contoured shape, as the casing of a window. It is only important that there be a generally continuous portion defining a perimeter, where a surface would more or less contact the portion about the perimeter when placed against it. Minor deviations from overall contact are acceptable, as the invention assemblies have adequate versatility to provide for the same, as by pivotation, while accomplishing the objectives of the invention.

Figure 1:
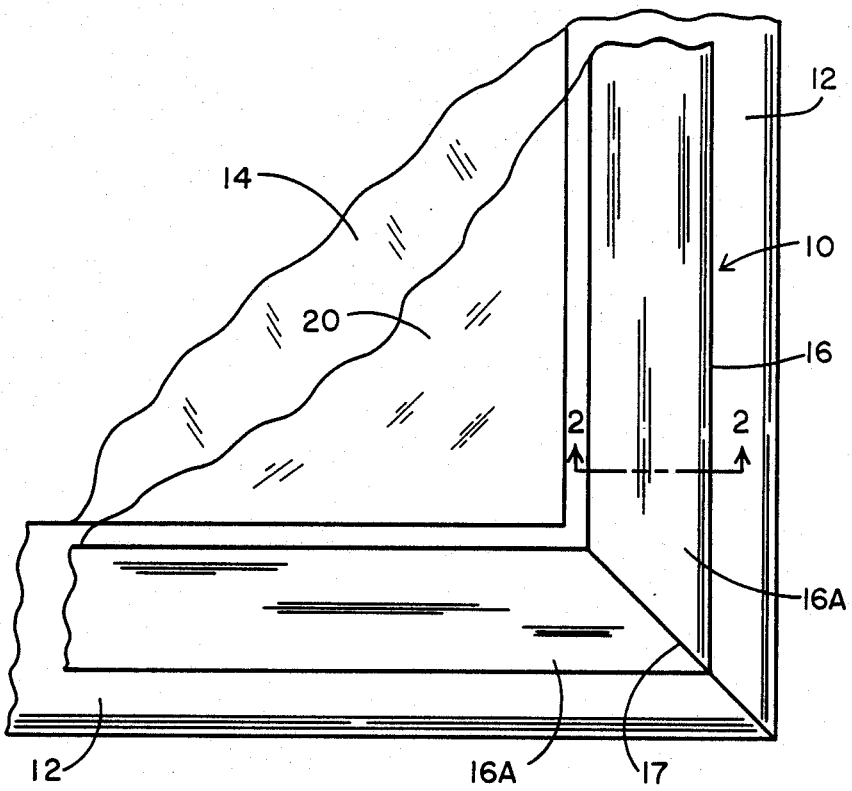
FIG. 1 is a fragmentary plan view of the assembly of the invention installed on a window.

FIGS. 1–4 illustrate a preferred assembly of the invention. FIG. 1 shows a fragment of a conventional window 12 with the assembly of this invention installed on it.

Figure 2:
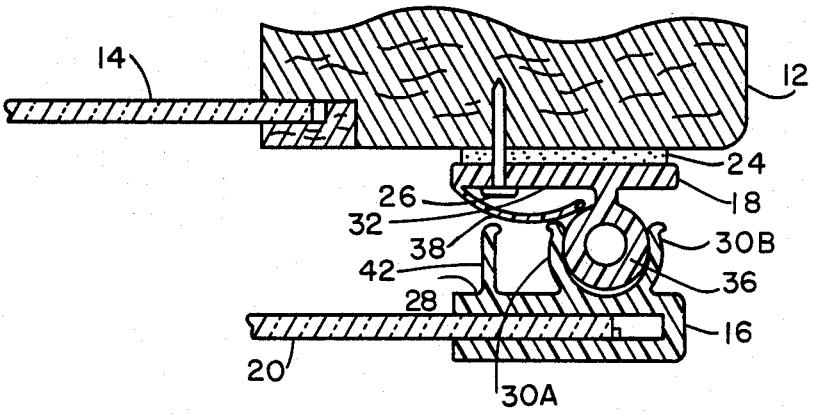
FIG. 2 is a cross section of the assembly and window, taken at 2—2 of FIG. 1.

FIG. 2 shows a cross section of the assembled assembly as it is installed in FIG. 1.

Figure 3:
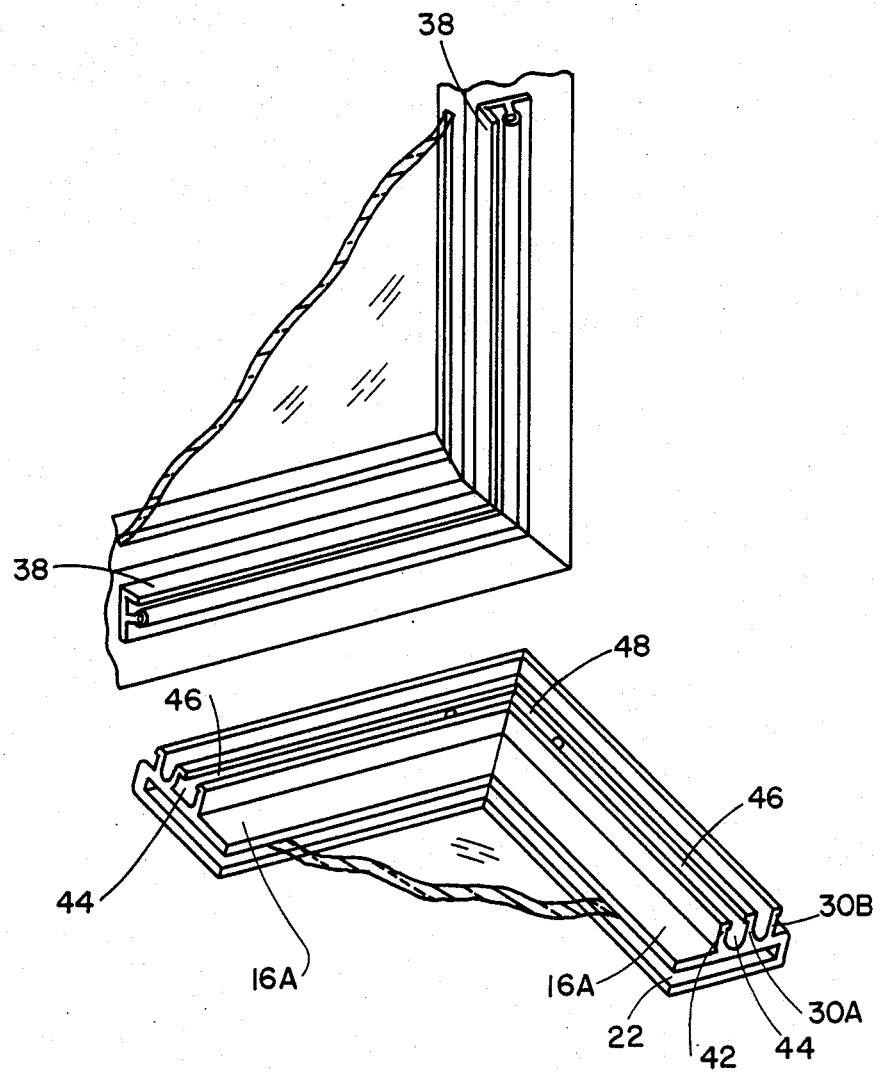
FIG. 3 is a fragmentary pictorial view of a preferred assembly of the invention installed on a window, with the frame separated from the adapter, and laid down to better show its functional components.

FIG. 3 shows the same window installation as in FIG. 1, but with the frame separated from the adapter, and laid down to show its functional components.

Figure 4:
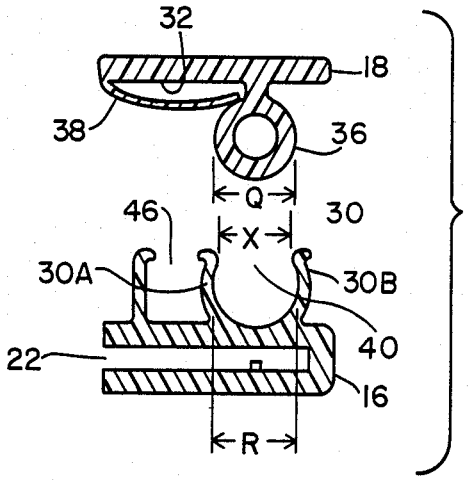
FIG. 4 is a cross section of the assembly as seen in FIG. 2, and shown with the frame and adapter separated.

FIG. 4 shows a cross section of the assembly of the invention, but with the frame and adapter separated.

Turning back, now to FIG. 1, there is seen an assembly 10 of the invention installed on the frame 12 of a conventional window installed in a building not shown. The term "frame" as used herein with respect to a conventional window, includes any member used for installation or holding of the window, or the finishing of the installation or holding. This includes adapters, framing, casing, trim, molding, and the like. The frame 12 seen in FIG. 1 is generally referred to as casing, and is the type of frame surface most often contemplated as the locus of attachment of panel assemblies of the invention. The conventional window in FIG. 1 is shown with the typical glazing 14, such as glass.

The assembly 10 has a frame 16 including a plurality of frame elements 16A which are joined at joint 17. Refering now to FIG. 2 it is seen that assembly frame 16 is separably joined with adapter 18, to thus attach the assembly frame 16 to the window frame 12. In FIGS. 1–3 the assembly 10 is shown with glazing 20 engaged in slot 22. The assembly 10 is in joinder with window frame 12 through tape 24, and nail 26. Frame 16 has a first base member 28, with a first retainer means 30 extending from it. The first retainer means has two legs 30A and 30B. Adapter 18 has a second base member 32 and a bulbous second retainer means 36 extending from it. First and second retainer means 30 and 36, respectively, are so cooperatively configured as to matingly engage and join under moderate force to hold frame 16 and adapter 18 together until such time as separation is desired. Separation is accomplished by grasping the frame and pulling it away from the adapter, to thus disengage first retainer means 30 from second retainer means 36.

A strip 38 is attached to adapter 18 at base member 32 and extends, as best seen in FIG. 4, generally toward the frame 16 and with its free edge disposed for engagement between the bulbous retainer means 36 and base member 32.

Strip 38 is preferably attached to base member 32 by a living hinge which gives it a bias for extending toward frame 16. It is preferably held under retainer means 36 with a slight tension.

Referring now to FIG. 2, it is seen that leg 30A may engage strip 38 in the assembled configuration at a point intermediate of its point of attachment to base member 32 and its free edge, further slightly depressing the strip under tension to further enhance the essentially air tight seal between first and second retainer means 30 and 36. Indeed the bias tension on strip 38 pushes slightly against leg 30A such that retainer means 30 is gently urged away from retainer means 36 until the slightly constricted neck 40 of retainer means 30 engages retainer means 36 through direct contact.

The assembly of the invention is most preferably made from plastics. In normal commercial plastics manufacturing processes, it is desirable to be able to allow minor tolerance in dimension of the various parts, such tolerances as, for example, allow for normal variations in shrink as the formed shapes cool and solidify. Thus there is commonly some space between the corresponding surfaces of retainer means 30 and retainer means 36, which space corresponds in these tolerances. Typically the maximum distance "R" between legs 30A and 30B is slightly greater than the corresponding distance "Q" across the bulbous retainer means 36. Thus legs 30A and 30B are preferably designed for a slight constriction of a smaller distance "X" at the neck 40, so that the width of the neck 40 is slightly narrower than the maximum width "Q" of bulbous second retainer means 36. In joinder of the first and second retainer means, legs 30A and 30B flex slightly away from each other to receive bulbous means 36. Once past the constriction, bulbous means 36 fits inside first retainer means 30 with small space between the two retainer means 30 and 36. The tension bias of strip 38 gently urges the frame and adapter away from each other, thus urging means 36 toward the neck 40 and snugly against it. This gentle urging results in a general surface-to-surface engagement of the retainer means 30 and 36 substantially at or near neck 40, along lines which extend about the perimeter of the assembly. This surface-to-surface engagement enhances the control of air infiltration which could otherwise occur about the assembly. While such infiltration is rather small without the use of strip 38, the strip is an assist in further approaching the overall goal of total control of air infiltration around the window.

Returning again to FIG. 2, a rib 42 is attached to, and extends from the first base member 28 of frame 16. Rib 42 is a means of strengthening the frame 16, enhancing its rigidity at economical cost of materials and processing. Further it may serve as a point of sealing contact with strip 38 as seen, for example, in FIGS. 5A and 5B. Yet another function of rib 42 is in its cooperation with leg 30A to form a separate channel 44. In the various illustrations in the drawings, channel 44 is shown with a constricted opening 46 along its length. A key 48 is shown inserted into channel 44 at a corner joint in the frame 16 in FIG. 3. The frame is most readily assembled by cutting frame elements 16A at appropriate lengths and angles to form a corner joint. The joints are then readily assembled by first inserting a key 48 into the channel 44 of one of the frame element ends, and then moving the other frame element into end-to-end relationship with the first frame element, and simultaneously inserting the key into the channel 44 on that frame element. The end result is that a corner is formed with the frame elements 16A in end-to-end relationship, and with key 48 extending between the frame elements and extending into each of the frame elements.

Rib 42 may be used without key 48 or strip 38. Examples of such structures are seen in cross section in FIGS. 5L, 5M and 5N. It is instructive that rib 42 may depend from frame 16 as in FIG. 5L, or from adapter 18 as in FIG. 5M, and the various combinations of elements used with rib 42 may be adapted for its dependency.

Figure 6:
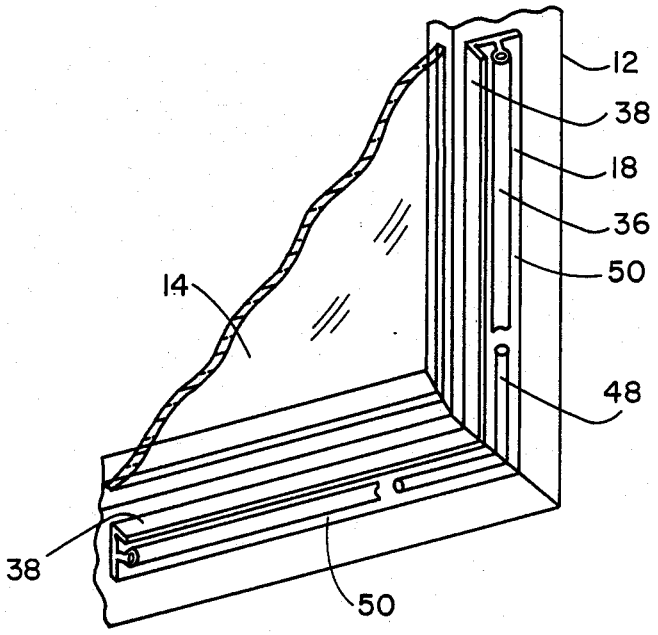
FIG. 6 is a fragmentary pictorial view of the assembly of the invention installed on a window, with the frame separated from the adapter to show an embodiment where a key is used in the channel of the retainer means on the frame, at a corner.

Key 48 may be used with or without rib 42. Its most preferred use is seen with rib 42 and channel 44 as in FIG. 3. Another example of the use of a key 48 is on adapter 18 as seen in FIG. 6. In that figure a portion of the bulbous retainer means 36 has been cut away to show key 48 as it extends between the adapter elements 50 and extends into each of the adapter elements 50.

Figure 7:
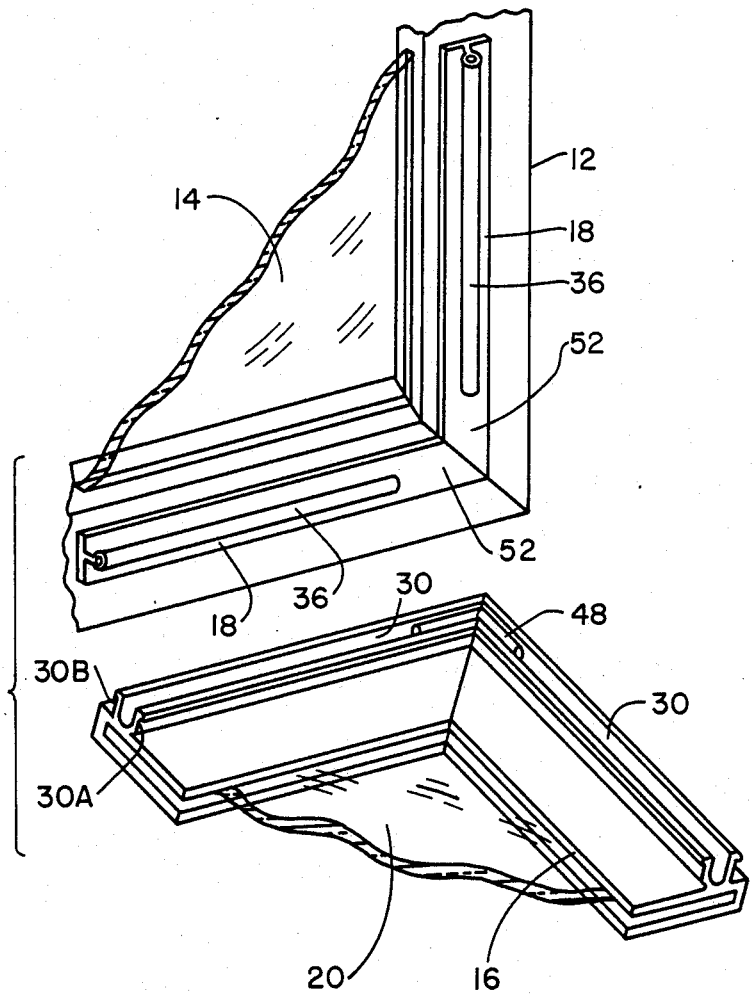
FIG. 7 is a fragmentary pictorial view of an adapter on a window frame and an associated assembly frame to show a key.

Further to the use of a key 48, FIG. 7 shows a key 48 in the first retainer means 30 on frame 16, such that it would normally interfere with the engagement of first retainer means 30 with a second retainer means 36 at the corner. The adapter in FIG. 7 is thus used without a bulbous portion in the area of the corner where there would otherwise be interference between a bulbous portion and the key. FIG. 7 shows the adapter with a bulbous portion absent as at 52.

From the foregoing description, it is seen that a great variety of embodiments may now be designed in accordance with the invention. The primary elements of novelty will be found in the strip 38, the rib 42, and the key 48; and in their placements such that they cooperate with each other and with the other elements of the assembly. Cross sections 5A through 5Q illustrate various of the cooperations. It should be clear, though, that many more embodiments may be shown; and wherein the figures show only examples of the invention and not all embodiments thereof.

Figure 5A:
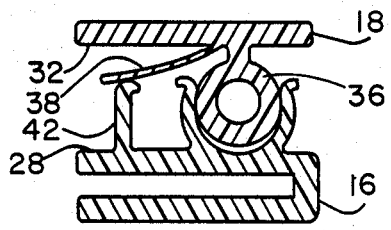
FIGS. 5, 5A through 5Q show, in cross section, examples of alternate cooperating designs for the assembly and a window frame. Note that there is no 5O.
Figure 5B:
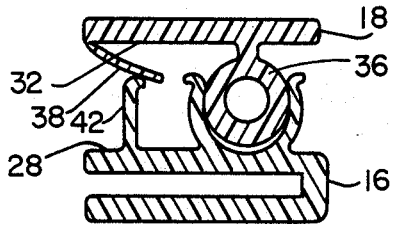
Figure 5C:
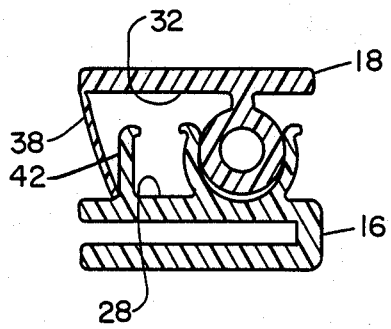
Figure 5D:
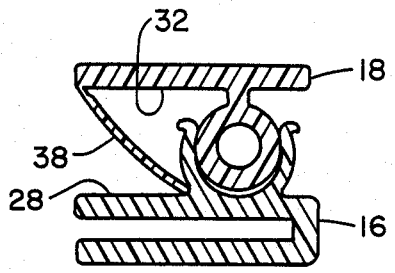
Figure 5E:
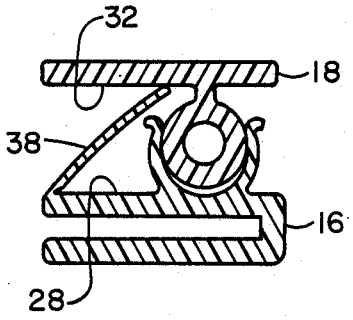
Figure 5F:
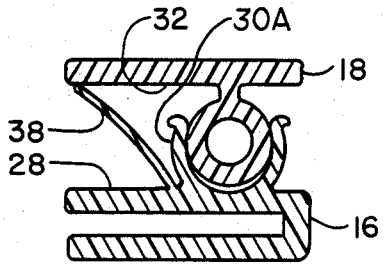
Figure 5G:
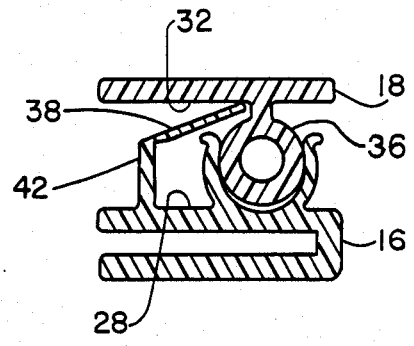
Figure 5H:
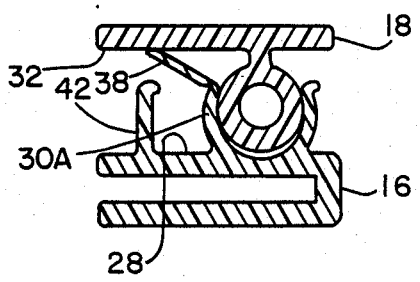
Figure 5I:
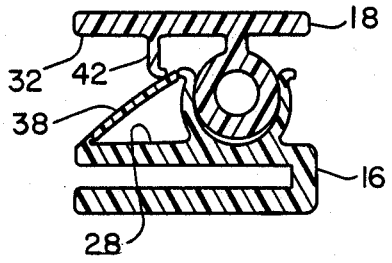
Figure 5J:
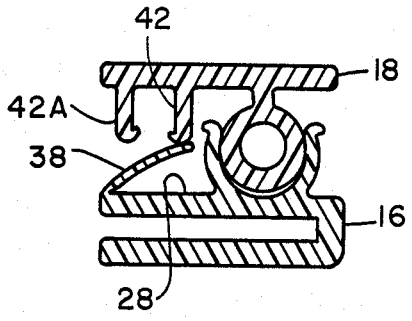
Figure 5K:
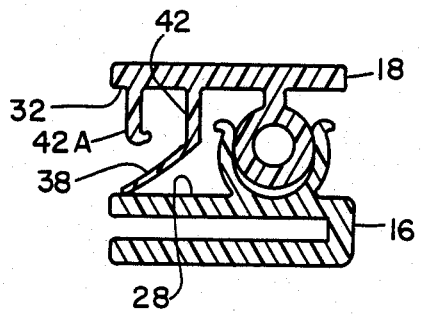
Figure 5L:
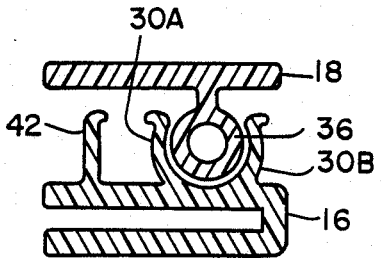
Figure 5M:
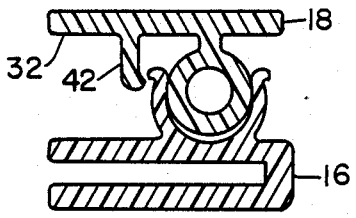
Figure 5N:
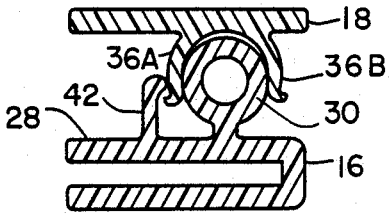
Figure 5P:
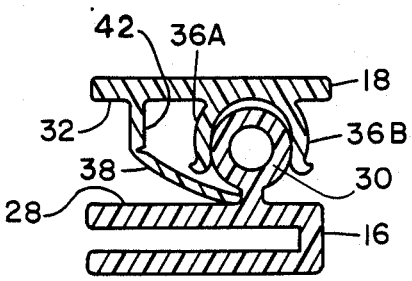
Figure 5Q:
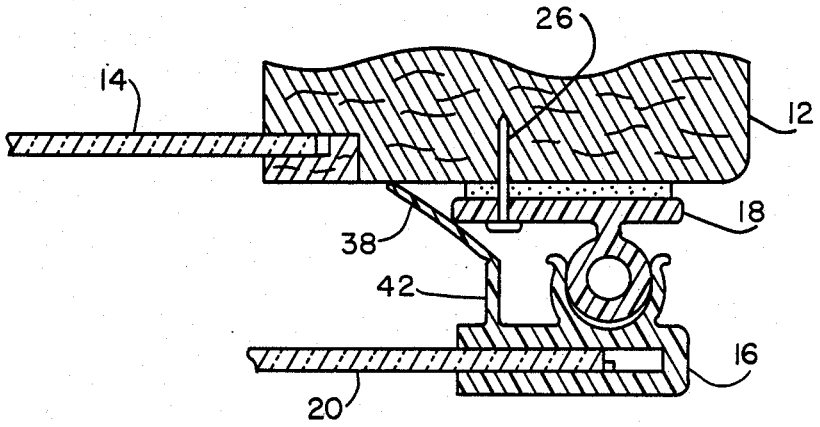

FIG. 5A shows a strip 38 attached to adapter 18 near the base of retainer means 36 and abutting rib 42. FIG. 5B shows the same general arrangement, but with strip 38 depending from an edge of adapter 18 and achieving a seal on the edge of rib 42. FIG. 5C shows the same arrangement as in FIG. 5B except that strip 38 extends to the base member 28 of frame 16. FIG. 5D is similar to FIG. 5C except that rib 42 is not part of the structure. In FIG. 5E the strip is attached to frame 16 and extends against base member 32 of adapter 18. In FIG. 5F the strip 38 likewise extends from base member 32 of frame 16 toward base member 28 of adapter 18; but the point of attachment is near retainer means leg 30A. In FIG. 5G the strip 38 is attached to rib 42 and extends toward the base of retainer means 36. In FIG. 5H, strip 38 is attached to leg 30A and extends to adapter 18. In FIG. 5I, strip 38 is attached to base member 28 of frame 16. As shown the strip extends to, and makes contact with, rib 42. FIG. 5J is similar to FIG. 5I with the addition of a second rib 42A to form a channel on adapter 18 such as for insertion of a key. FIG. 5K is similar to FIG. 5J except that strip 38 is attached to rib 42 and extends toward frame base member 28. FIG. 5L shows rib 42 on frame 16. FIG. 5M shows rib 42 attached to adapter 18. FIG. 5N shows a bulbous retainer means on frame 16, and a channel-type receiving retainer means 36 on adapter 18, and shown as legs 36A and 36B. Essentially the designs of the two retainer means have been reversed between the adapter and the frame, as is also true in FIG. 5P. Returning to FIG. 5N, a rib 42 is attached to frame 16 and extends toward adapter 18, and is so positioned as to engage leg 36A between rib 42 and retainer means 30. FIG. 5P shows a strip 38 extending from a rib 42 in conjunction with the same reversal of designs of the two retainer means as in FIG. 5N. FIG. 5Q includes, as part of its cross section, the window frame 12, and shows a strip 38 depending from a rib 42 on a frame 16, and extending toward, and engaging the window frame 12, to form a seal between strip 38 and window frame 12.

In the preferred embodiment, shown as in FIG. 3, the strip 38 as two primary positions. In its relaxed position, shown in FIG. 3, the free edge of the strip is not restrained, and is indeed slightly angled away from bulbous retainer means 36. It can be temporarily rotated outwardly about its living hinge-type attachment to base member 32 to allow emplacement of fasteners, such as nails, staples and the like. Any rotation away from its rest position generates a restorative spring-like force. So when the outward rotation is relaxed, the strip returns to its rest position. For use in the assembly, the end of the strip is preferably pushed below bulbous retainer means 36 such that the edge is caught there by the bulb, as seen in FIG. 4. Because that position is a rotation from the rest position, a restorative force attempts to move the edge of the strip further away from the base member 32. This constant restorative force makes it act like a spring, and to be in contact with whatever touches or moves it. Thus, when legs 30A contacts strip 38 and moves it slightly, there is restorative force urging the strip 38 toward leg 30A; thereby creating a seal point. Similar seal points are made in all the embodiments which use the strip by being careful to manufacture strip 38 such that it is deflected away from its rest position in the assembled assembly 10. It is seen that, in the embodiment of FIGS. 2–4, strip 38 and retainer 36 are attached to base member 32 at locations spaced from each other, defining a surface of the base member 32 which is between the attachments of the strip 38 and the retainer 36. Thus, when the free edge of strip 38 is pushed below bulbous retainer means 36 such that the edge is held there by the bulb, strip 38 extends over that defined surface and covers it. The covering function of strip 38 serves two purposes. First, it tends to keep dirt from getting onto the base 32 of the adapter. Second, as seen in FIG. 2, it covers fasteners 26 such that they are not readily visible, a function especially apparent when frame 16 is removed from the assembly as in FIG. 4.

In attachment of the assembly as in FIG. 3 to a window, two-sided tape is attached to the adapter as at 24 in FIG. 2. The whole assembled assembly is then pressed against the window frame, and the assembly frame is carefully separated from the adapter, leaving the adapter attached to the window frame by tape 24. Strip 38 is then rotated back away from its rest position to expose base member 32 of adapter 18 as in FIG. 3. Permanent fastening means, such as nails, staples or screws, are then used to permanently attach the adapter to the window frame. Strip 38 is then rotated to a position under bulbous retainer means 36, as seen in FIG. 4. Finally frame 16 is pushed back onto the assembly for the completion of installation of the assembly. The assembly then looks, in cross-section, like the assembly in FIG. 2. Once installation is complete, the frame may be alternately joined and separated from the adapter-window combination, as desired.

Having thus described the invention, what is claimed is:

1. A framed panel assembly for attachment to a surface, said framed panel assembly comprising:

(a) a panel assembly frame having a first perimeter, said frame having means for receiving a panel, and having a first retainer means attached to a face of said frame and extending about said frame;

(b) an adapter, to cooperatively attach said frame to said surface, said adapter having a second perimeter, and a second retainer means for joining with said first retainer means, said adapter extending about said assembly frame in joined relationship therewith; and (c) a strip, said strip having first and second edges, said first edge thereof being attached to one of said frame and said adapter, the other of said frame and said adapter contacting said strip upon assemblage of said assembly, said frame comprising a first base member and said first retainer means, said first retainer means extending from said first base member, said adapter comprising a second base member and said second retainer means, said second retainer means extending from said second base member, one of said first and second retainer means having a bulbous portion, said bulbous portion being attached to the corresponding one of said first and second base members, said second edge of said strip being disposed for engagement against said bulbous portion upon assemblage of said assembly.

2. A framed panel assembly as in claim 1, said strip extending along the length of said one of said frame and said adapter.

3. A framed panel assembly for attachment to a surface, said framed panel assembly comprising:

(a) a panel assembly frame having a first perimeter, said frame having means for receiving a panel, and having a first retainer means attached to a face of said frame and extending about said frame;

(b) an adapter, to cooperatively attach said frame to said surface, said adapter having a second perimeter, and a second retainer means for joining with said first retainer means, said adapter extending about said assembly frame in joined relationship therewith; and (c) a strip, said strip having first and second edges;

said frame comprising a first base member and said first retainer means, said first retainer means extending from said first base member, said adapter comprising a second base member and said second retainer means, said second retainer means extending from said second base member, said second retainer means having a bulbous portion, said bulbous portion being attached to said second base member, said first edge of said strip being attached to said second base member, said second edge of said strip being disposed for engagement between said bulbous portion and said second base member.

4. A framed panel assembly as in claim 3, said strip extending along the length of said adapter.

5. An adapter for use in a framed panel assembly to cooperatively attach a frame to a surface, said adapter having retainer means for joining said frame to said adapter, and including a strip having a first edge thereof attached to said adapter and a second edge capable of engagement with said retainer means and wherein said adapter has a base member, said strip being attached to said adapter at said base member, said retainer means being attached to said base member at a location spaced from said attachment of said strip, defining a surface of said base member between attachments of said strip and said retainer means, and wherein, when said strip is in engagement with said retainer means, said strip extends over said surface.

6. A framed panel assembly, comprising:

(a) a panel assembly frame having a first perimeter, said frame having means for receiving a panel, and having a first retainer means attached to a face of said frame and extending about said frame; and (b) an adapter to cooperatively attach said frame to a surface, said adapter having a second perimeter, and a second retainer means for joining with said first retainer means, said adapter extending about said assembly frame in joined relationship therewith, said adapter including a strip having a first edge thereof attached to said adapter and a second edge capable of engagement with said second retainer means, and wherein said adapter has a base member, said strip being attached to said adapter at said base member, said retainer means being attached to said base member at a location spaced from said attachment of said strip, defining a surface of said base member between said attachments of said strip and said retainer means, and wherein, when said strip is in engagement with said retainer means, said strip extends over said surface.

7. A framed panel assembly as in claim 6 wherein said frame contacts an intermediate portion of said strip, and does not contact said second edge, upon assemblage of said assembly.

* * * * *